US010541101B1

(12) United States Patent
Yang et al.

(10) Patent No.: US 10,541,101 B1
(45) Date of Patent: Jan. 21, 2020

(54) ELECTRIC LEAKAGE PROTECTOR

(71) Applicant: Dongguan City Tuocheng Industries Co., Ltd., Dongguan (CN)

(72) Inventors: Juntuo Yang, Dongguan (CN); Siwei Zhu, Dongguan (CN)

(73) Assignee: Dongguan City Tuocheng Industries Co., Ltd., Dongguan (CN)

( * ) Notice: Subject to any disclaimer, the term of this patent is extended or adjusted under 35 U.S.C. 154(b) by 0 days.

(21) Appl. No.: 16/264,021

(22) Filed: Jan. 31, 2019

(30) Foreign Application Priority Data

Dec. 24, 2018 (CN) ..... 2018 2 2181466

(51) Int. Cl.

| | |
|---|---|
| ***H01H 9/00*** | (2006.01) |
| ***H01H 71/58*** | (2006.01) |
| ***H01R 24/28*** | (2011.01) |
| ***H01R 13/713*** | (2006.01) |
| ***H01R 13/66*** | (2006.01) |

(52) U.S. Cl.
CPC ..... *H01H 71/58* (2013.01); *H01R 13/6683* (2013.01); *H01R 13/713* (2013.01); *H01R 24/28* (2013.01)

(58) Field of Classification Search
CPC ... H01H 1/00; H01H 3/00; H01H 9/00; H01R 13/6666
USPC ..... 361/115, 88; 439/620.08
See application file for complete search history.

(56) References Cited

U.S. PATENT DOCUMENTS

| | | | | |
|---|---|---|---|---|
| 3,813,579 A * | 5/1974 | Doyle | H01H 71/505 | 361/46 |
| 4,209,762 A * | 6/1980 | Samborski | H01H 83/04 | 335/18 |
| 6,016,244 A * | 1/2000 | Gershen | H01H 83/02 | 361/42 |
| 6,958,895 B1 * | 10/2005 | Radosavljevic | H01H 3/001 | 335/15 |

* cited by examiner

*Primary Examiner* — Hien D Vu
(74) *Attorney, Agent, or Firm* — Wang Law Firm, Inc.

(57) ABSTRACT

An electric leakage protector includes a reset mechanism, a breaker mechanism, and a current detecting mechanism. The current detecting mechanism is used to control the breaker mechanism which includes a separated elastic member driving the moving contact to descend, and the reset mechanism includes a reset column, a connecting member, a first reset elastic member, a moving seat, and a second reset elastic member. The separated elastic member is coupled to the connecting member through the moving seat, and the reset column has a latch groove for latching the connecting member. The breaker mechanism is used to drive the connecting member to retreat from the latch groove, and the second reset elastic member is used to drive the reset column to ascend. After the reset column descends, the first reset elastic member drives the connecting member to be latched into the latch groove to miniaturize the electric leakage protector.

10 Claims, 10 Drawing Sheets

A-A'

ELECTRIC LEAKAGE PROTECTOR

FIELD OF THE INVENTION

The present invention generally relates to the field of electrical safety technology, and more particularly to an electric leakage protector.

BACKGROUND OF THE INVENTION

Electric leakage protector is a device for protecting a human body and preventing death caused by electric shocks. In the principle of the electric leakage protector, a breaker mechanism is provided to disconnect a circuit when the human body is detected to be electrically shocked, so as to reducing the damage to the human body.

After the risk of the electric shock is eliminated, the electric leakage protector needs to be reset in order to connect the circuit again. However, the structure of the reset mechanism in the conventional electric leakage protector is complicated, which makes the structure of the electric leakage protector not compact enough to be miniaturized.

SUMMARY OF THE INVENTION

Therefore, it is a primary objective of the present invention to overcome the aforementioned drawbacks of the prior art by providing an electric leakage protector of a reset mechanism with a simple structure and a compact structure of the electric leakage protector for the miniaturization of the electric leakage protector.

To achieve the aforementioned objective, the present invention provides an electric leakage protector comprising an input terminal, an output terminal, a reset mechanism, a breaker mechanism and a current detecting mechanism for detecting the current condition of a circuit formed by the input terminal and the output terminal, and the input terminal having a fixed contact electrically coupled thereto, and the output terminal having a moving contact electrically coupled thereto, and an output terminal of the current detecting mechanism being coupled to a control terminal of the breaker mechanism, and the breaker mechanism being used for driving the moving contact and the fixed contact to be separated from each other, and the reset mechanism being used for driving the moving contact to be contacted with the fixed contact; the breaker mechanism comprising a separated elastic member for driving the moving contact to descend, and the reset mechanism comprising a reset column, a connecting member, a first reset elastic member, a moving seat and a second reset elastic member, and the separated elastic member being coupled to the connecting member through the moving seat, and the reset column having a latch groove for latching the connecting member, and the breaker mechanism being provided for driving the connecting member to retreat from the latch groove, and the second reset elastic member being provided for driving the reset column to ascend; and the first reset elastic member driving the connecting member to be latched into the latch groove after the reset column descends.

Preferably, the breaker mechanism comprises a hammer seat, an electromagnet electrically coupled to the current detecting mechanism, and an electric hammer slidably coupled to the hammer seat, and the electromagnet is provided for attracting the electric hammer, and the electric hammer has a bump formed at an outer periphery thereof, and the connecting member has a contact portion for abutting an end of the bump away from the connecting member, and the connecting member further comprises a giving-way groove, and the electric hammer is moved in the giving-way groove.

Preferably, the electric leakage protector further comprises a PCB, and an end of the separated elastic member and the fixed contact are fixed to the PCB, and the other end of the separated elastic member is fixed to the moving seat, and the moving contact is fixed to the other end of the separated elastic member.

Preferably, the reset column has a reset block disposed at an outer periphery thereof, and the second reset elastic member has an end coupled to the reset block and the other end coupled to the PCB.

Preferably, the moving seat has a sliding chute for passing the connecting member.

Preferably, the connecting member has an accommodating slot for accommodating the first reset elastic member, and the first reset elastic member has an end coupled to the moving seat and the other end coupled to a slot wall of the accommodating slot.

Preferably, the moving seat has a through slot for passing the reset column.

Preferably, the electric leakage protector further comprises a base, and the base has a limit slot slidably coupled to the moving seat.

Preferably, the separated elastic member is made of an electrically conductive material, and the fixed contact is electrically coupled to the output terminal through the separated elastic member.

Preferably, the electric leakage protector further comprises a conductive wire, and the input terminal including a first conductive pin and a second conductive pin for clamping the conductive wire.

The present invention has the following advantages and effects: With a simplified structure of the reset mechanism, the structure of the electric leakage protector is compact, so that the electric leakage protector can be miniaturized.

DESCRIPTION OF THE PREFERRED EMBODIMENTS

Figure 1:
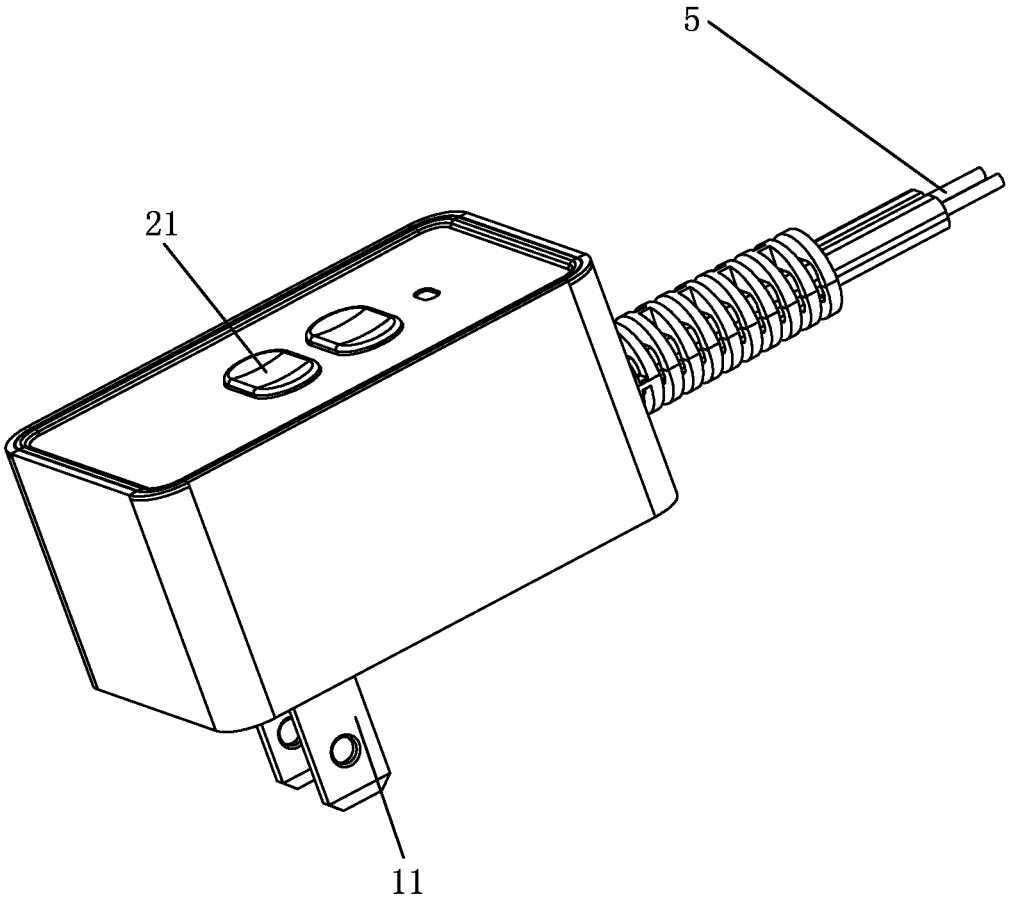
FIG. 1 is a perspective view of the present invention.
Figure 2:
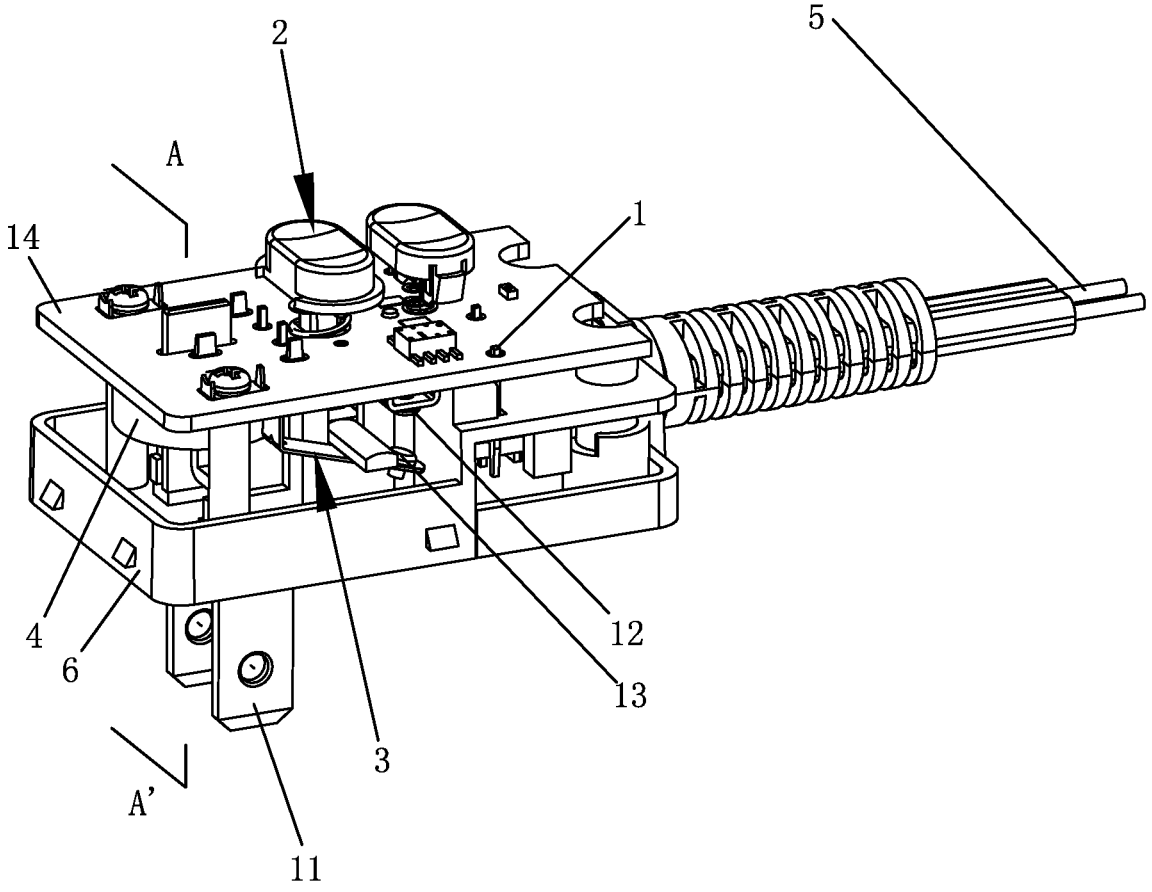
FIG. 2 is a perspective view of the internal structure of the present invention.

The technical contents of the present invention will become apparent with the detailed description of preferred embodiments accompanied with the illustration of related drawings as follows. It is intended that the embodiments and figures disclosed herein are to be considered illustrative rather than restrictive.

With reference to FIGS. 1 to 4 and 8 to 10 for an electric leakage protector of the present invention, the electric leakage protector comprises an input terminal 1, an output terminal 11, a reset mechanism 2, a breaker mechanism 3, and a current detecting mechanism 4 for detecting the current condition of a circuit formed by the input terminal 1 and the output terminal 11, wherein the input terminal 1 has a fixed contact 12 electrically coupled to the input terminal 1, and the output terminal 11 has a moving contact 13 electrically coupled to the output terminal 11, and an output terminal of the current detecting mechanism 4 is coupled to a control terminal of the breaker mechanism 3, and the breaker mechanism 3 is provided for driving the moving contact 13 and the fixed contact 12 to be separated from each other, and the reset mechanism 2 is provided for driving the moving contact 13 to be contacted with the fixed contact 12. The breaker mechanism 3 comprises a separated elastic member 31 for driving the moving contact 13 to descend, and the reset mechanism 2 comprises a reset column 21, a connecting member 22, a first reset elastic member 23, a moving seat 24 and a second reset elastic member 25, and the separated elastic member 31 is coupled to the connecting member 22 through the moving seat 24, and the reset column 21 has a latch groove 211 for latching the connecting member 22. The breaker mechanism 3 is provided driving the connecting member 22 to retreat from the latch groove 211. The second reset elastic member 25 is provided for driving the reset column 21 to ascend. The first reset elastic member 23 drives the connecting member 22 to be latched into the latch groove 211 after the reset column 21 descends.

Specifically, the current detecting mechanism 4 is a zero sequence transformer; the first reset elastic member 23 and the second reset elastic member 25 are springs; the separated elastic member 31 is a spring plate. Normally, the fixed contact 12 is contacted with the moving contact 13. Now, the connecting member 22 is latched into the latch groove 211 of the reset column 21, and the reset column 21 needs a larger force to descend under the limitation of the first reset elastic member 23. Therefore, it is difficult for the connecting member 22 and the separated elastic member 31 coupled to the connecting member 22 through the moving seat 24 to move, and the separated elastic member 31 cannot drive the moving contact 13 and the fixed contact 12 to be separated from each other. After the current detecting mechanism 4 detects an electric shock of a human body, the breaker mechanism 3 drives the connecting member 22 to retreat from the latch groove 211 of the reset column 21, and the first reset elastic member 23 is compressed. Now, the connecting member 22 and the separated elastic member 31 coupled to the connecting member 22 through the moving seat 24 are no longer limited by the reset column, and the connecting member 22 can descend. In the meanwhile, the separated elastic member 31 drives the moving contact 13 and the fixed contact 12 to be separated from each other. After the moving contact 13 and the fixed contact 12 are separated from each other, the latch groove 211 and the connecting member 22 are not aligned precisely with each other, so that the first reset elastic member 23 cannot drive the connecting member 22 to be latched into the latch groove 211. For a reset, the reset column 21 is pressed to descend the reset column 21. After the reset column 21 descends, the latch groove 211 will be aligned precisely with the connecting member 22, so that the connecting member 22 driven by the first reset elastic member 23 can be latched into the latch groove 211, and then the second reset elastic member 25 drives the reset column 21 to ascend. Therefore, both of the connecting member 22 and the separated elastic member 31 coupled to the connecting member 22 through the moving seat 24 ascend, and the moving contact 13 also ascends to touch the fixed contact 12. With the simplified structure of the reset mechanism 2 of the present invention, the electric leakage protector has a compact structure to facilitate the miniaturization of the electric leakage protector.

Figure 3:
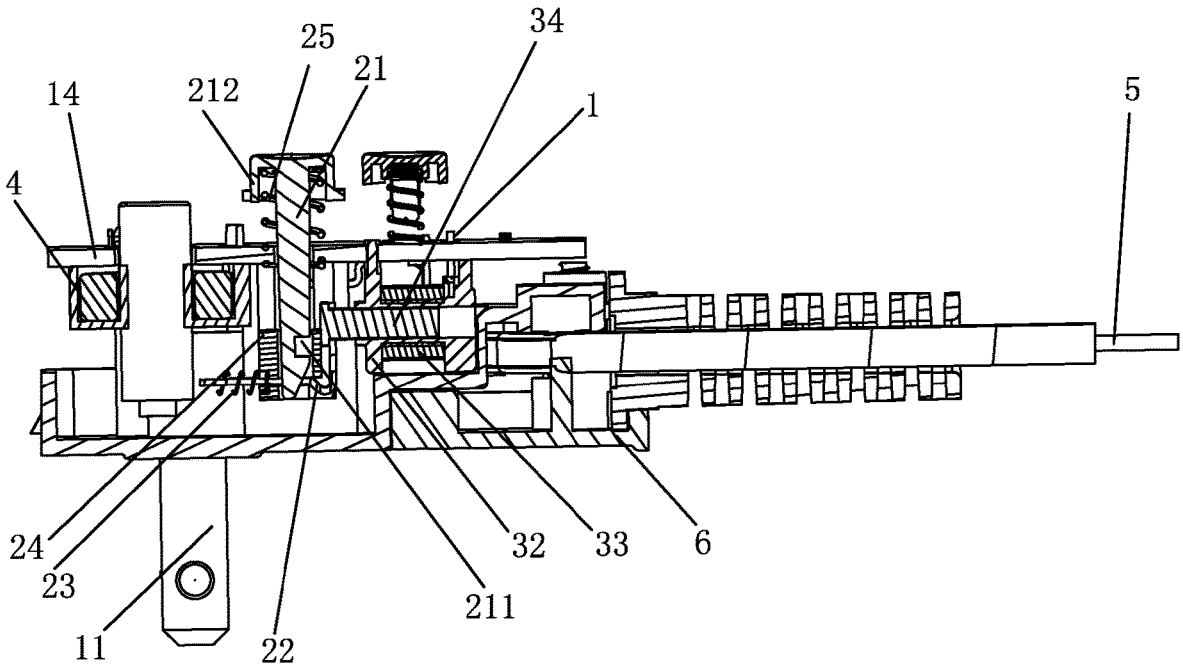
FIG. 3 is a cross-sectional view of Section A-A' of FIG. 2.
Figure 4:
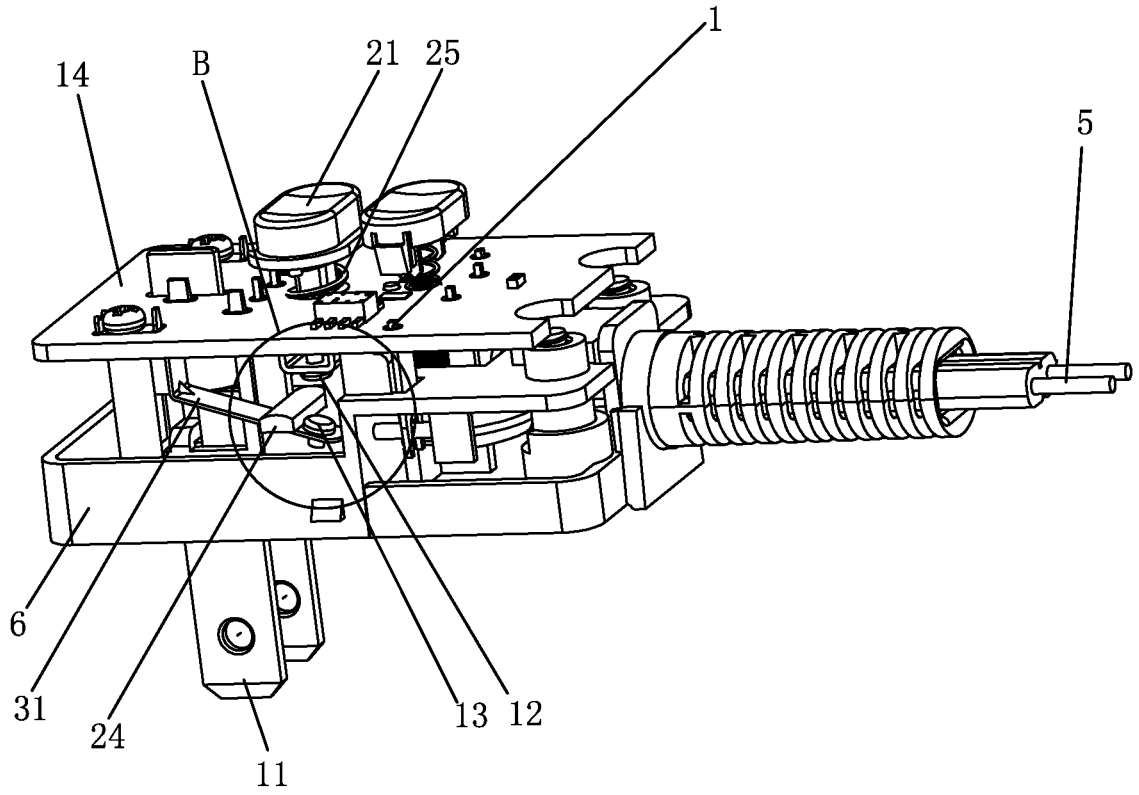
FIG. 4 is another perspective view of the internal structure of the present invention.
Figure 5:
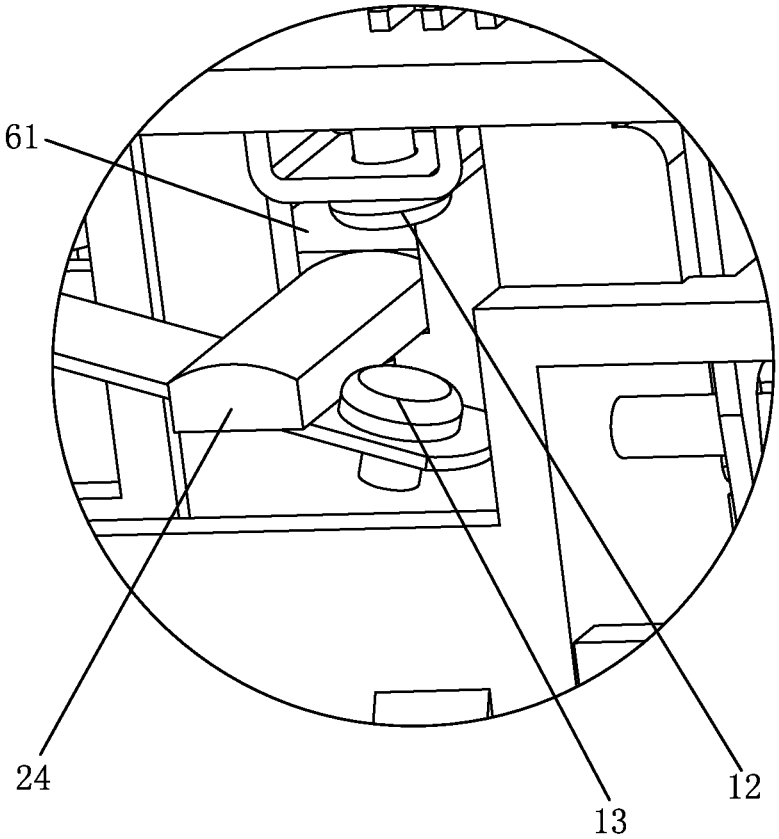
FIG. 5 is a partial blowup view of Section B of FIG. 4.
Figure 6:
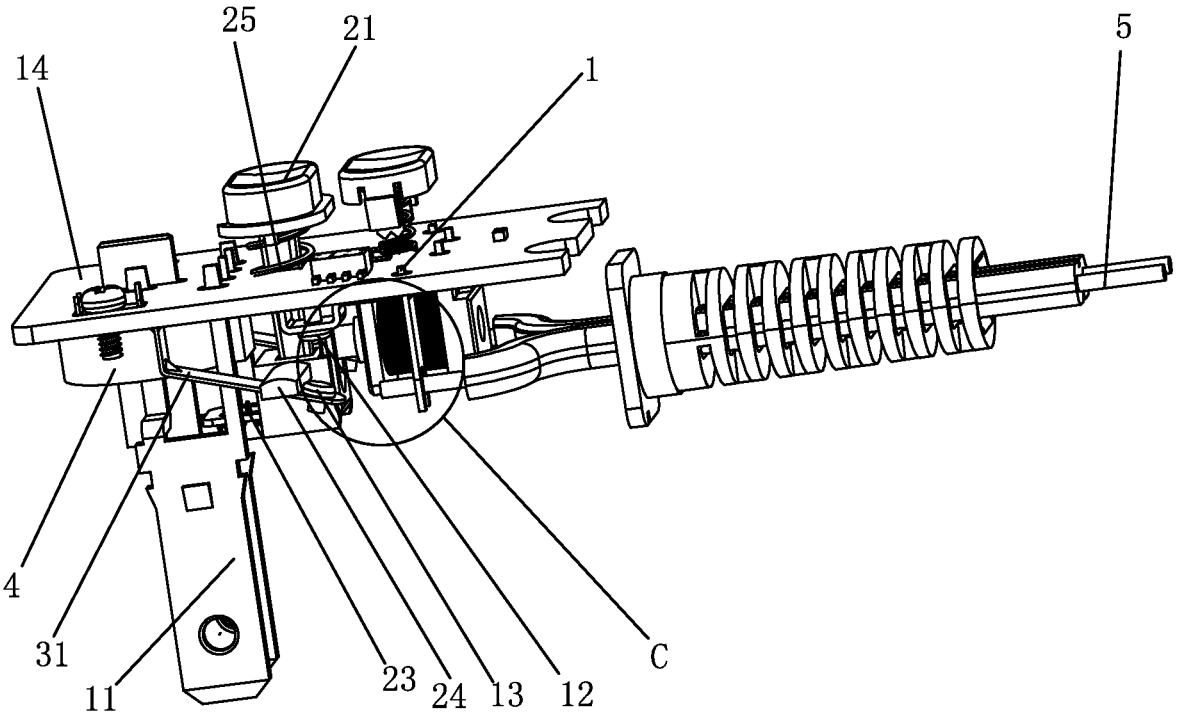
FIG. 6 is a perspective view of the internal structure hidden in a base in accordance with the present invention.
Figure 7:
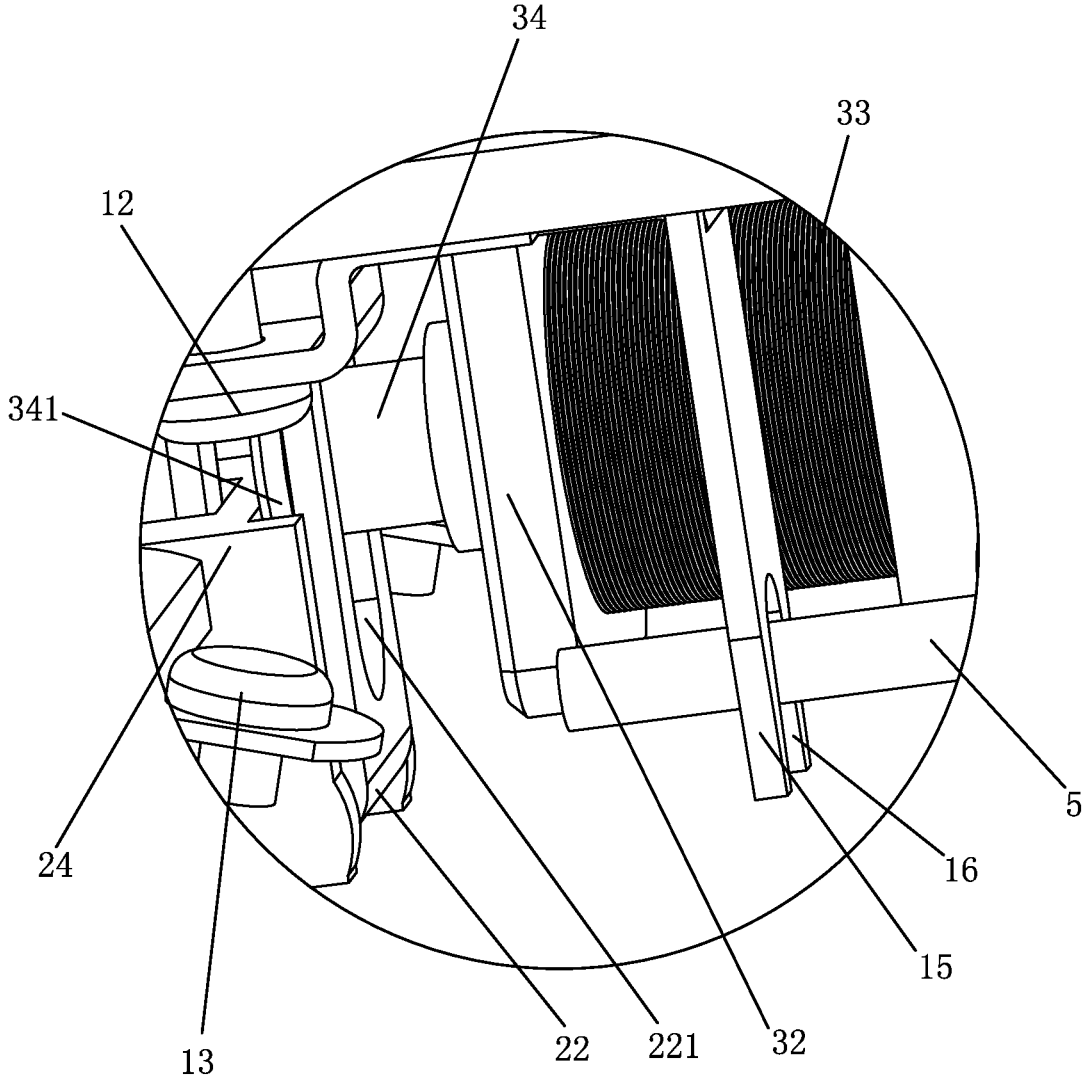
FIG. 7 is a partial blowup view of Section C of FIG. 6.
Figure 8:
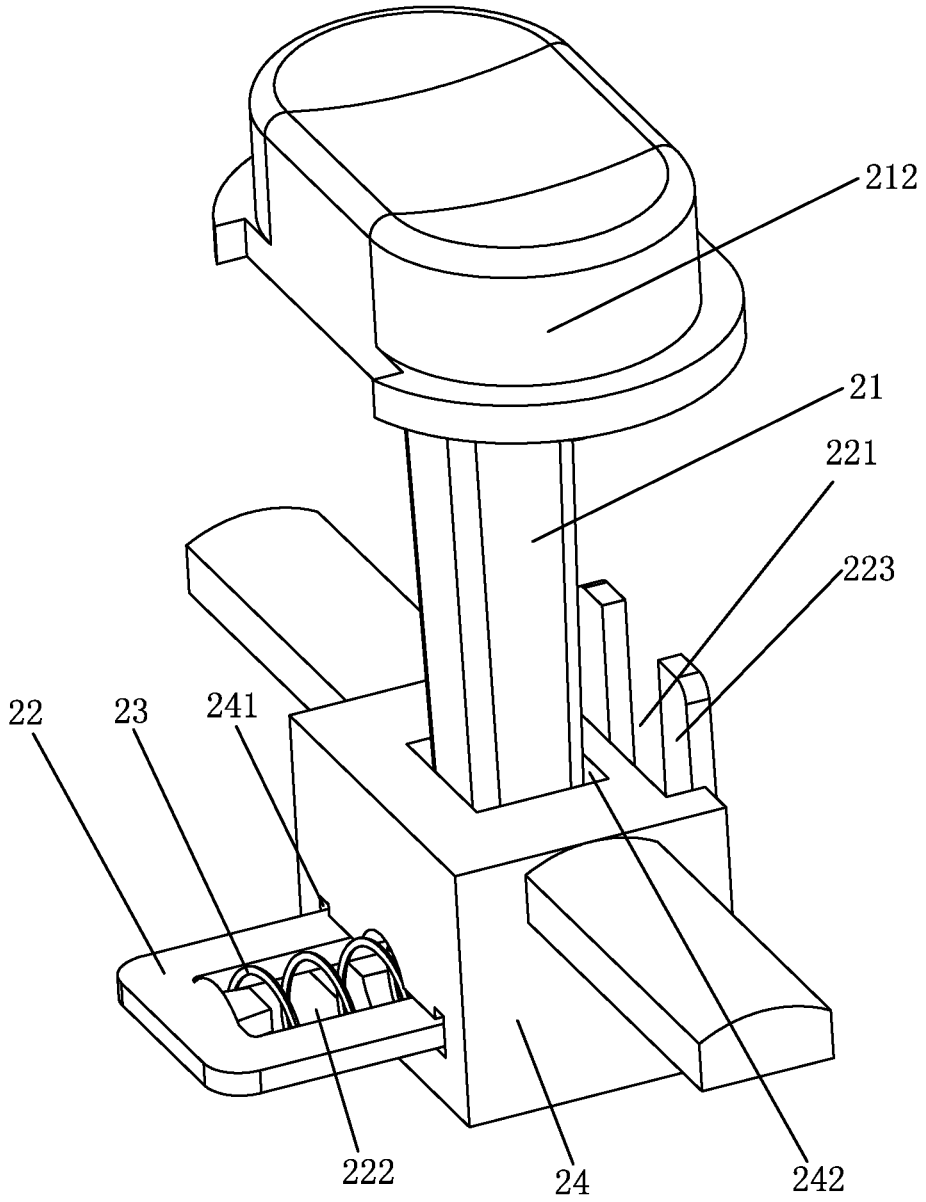
FIG. 8 is a perspective view of the present invention with a moving seat, a reset column and a connecting member.

In FIGS. 3, 7, and 8, the breaker mechanism 3 comprises a hammer seat 32, an electromagnet 33 electrically coupled to the current detecting mechanism 4, and an electric hammer 34 slidably coupled to the hammer seat 32, and the electromagnet 33 is provided for attracting the electric hammer 34, and the electric hammer 34 has a bump 341 formed at the outer periphery of the electric hammer 34, and the connecting member 22 has a contact portion 223 provided for abutting an end of the bump 341 away from the connecting member 22, and the connecting member 22 further comprises a giving-way groove 221, and the electric hammer 34 is moved in the giving-way groove 221. The connecting member 22 has to descend while being driven by the reset column 21 and to move transversely while being driven by the breaker mechanism 3, so that the present invention provides the giving-way groove 221 formed on the connecting member 22 for giving way to the electric hammer 34 in order to prevent the electric hammer 34 from affecting the elevation of the connecting member 22. When it is necessary to break the circuit, the electromagnet 33 attracts the electric hammer 34 and the electric hammer 34 moves in a direction away from the connecting member 22, the connecting member 22 driven by the electric hammer 34 also moves and retreats from the latch groove 211 of the reset column 21.

In FIGS. 2 to 6, the electric leakage protector further comprises a PCB 14, and an end of the separated elastic member 31 and the fixed contact 12 are fixed to the PCB 14, and the other end of the separated elastic member 31 is fixed to the moving seat 24, and the moving contact 13 is fixed to the other end of the separated elastic member 31. The reset column 21 has a reset block 212 disposed at an outer periphery of the reset column 21, and the second reset elastic member 25 has an end coupled to the reset block 212 and the other end the other end coupled to the PCB 14. In the electric leakage protector, the PCB 14 is installed and used as a fixed member, and thus the present invention no longer requires an additional fixing member and simplifies the structure of the electric leakage protector effectively.

In FIG. 8, the moving seat 24 has a sliding chute 241 for passing the connecting member 22, so that the connecting member 22 can drive the moving seat 24 to ascend. In the meanwhile, the moving seat 24 will not hinder the transverse movement of the connecting member 22.

Figure 9:
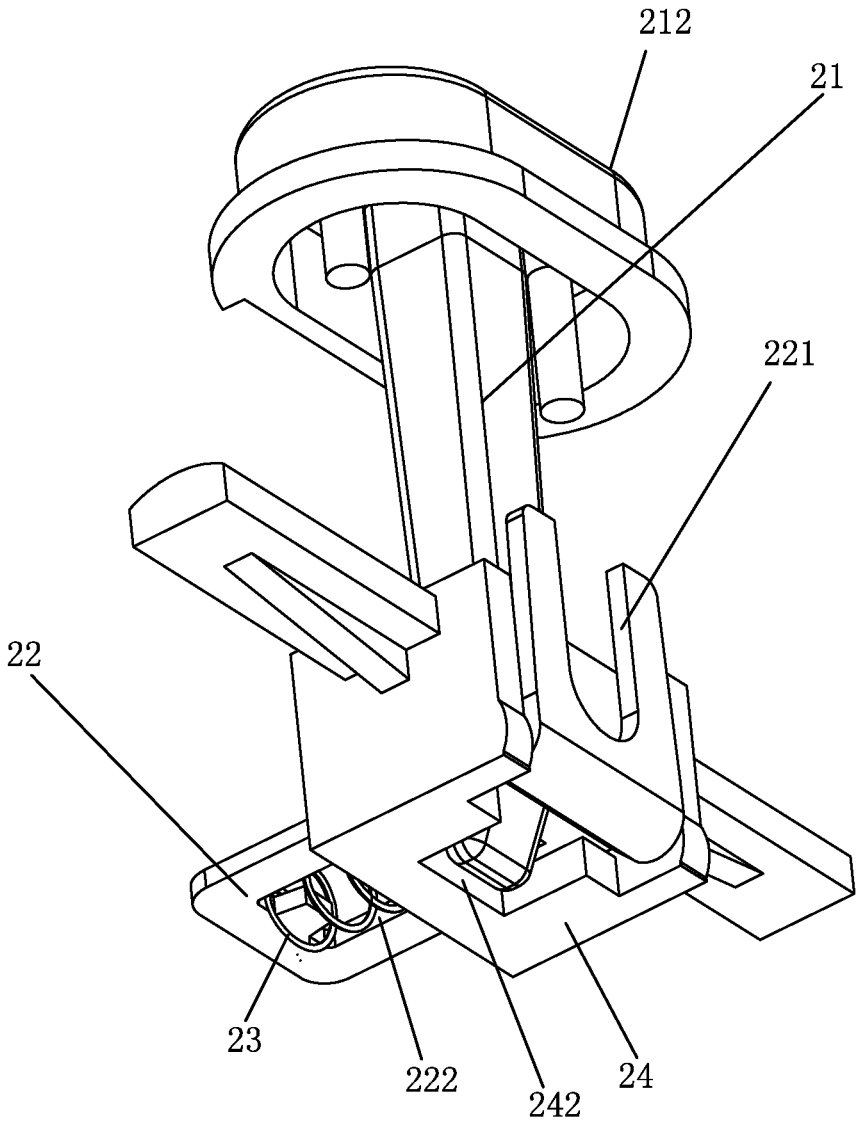
FIG. 9 is another perspective view of the present invention with a moving seat, a reset column and a connecting member.
Figure 10:
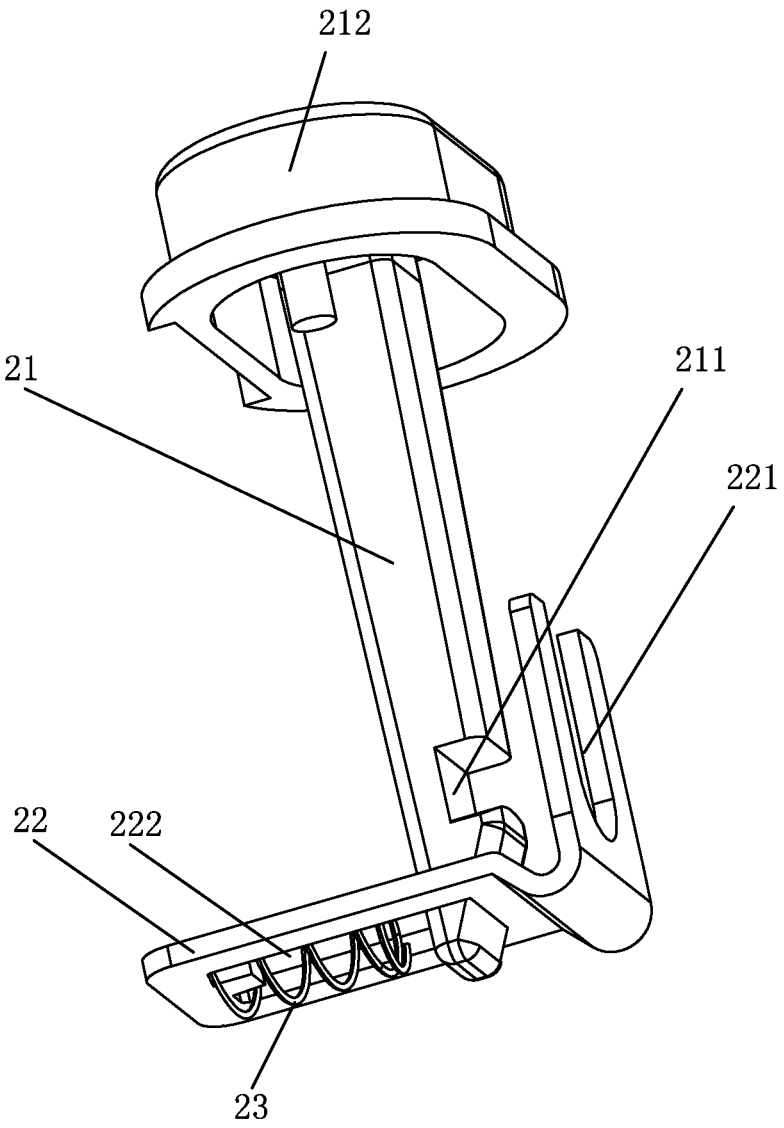
FIG. 10 is a perspective view of the present invention with a reset column and a connecting member.

In FIGS. 8 to 10, the connecting member 22 has an accommodating slot 222 for accommodating the first reset elastic member 23, and the first reset elastic member 23 has an end coupled to the moving seat 24 and the other end coupled to a slot wall of the accommodating slot 222. The accommodating slot 222 limits the first reset elastic member 23 to prevent the first reset elastic member 23 to move.

In FIG. 8, the moving seat 24 has a through slot 242 for passing the reset column 21, and the reset column 21 is capable of limiting the moving track of the moving seat 24 to prevent the moving seat 24 deviating from the moving track or leading to a poor contact between the fixed contact 12 and the moving contact 13.

In FIGS. 2 to 5, the electric leakage protector further comprises a base 6, and the base 6 has a limit slot 61 slidably coupled to the moving seat 24. The limit slot 61 further limits the moving track of the moving seat 24 to prevent the moving seat 24 deviating from the moving track or leading to a poor contact between the fixed contact 12 and the moving contact 13.

The separated elastic member 31 is made of an electrically conductive material, and the fixed contact 12 is electrically coupled to the output terminal 11 through the separated elastic member 31 without requiring the use of any other electrically conductive component. The output terminal 11 may be electrically coupled to the separated elastic member 31 through a soldering method or a jump wire method of the PCB 14. The input terminal 1 may also be electrically coupled to the fixed contact 12 through a soldering method or a jump wire method of the PCB 14.

In FIG. 7, the electric leakage protector further comprises a conductive wire 5, and the input terminal 1 has a first conductive pin 15 and a second conductive pin 16, and the first conductive pin 15 and the second conductive pin 16 are used to clamp the conductive wire 5. The conductive wire 5 is provided for passing external current into the electric leakage protector. In the conventional electric leakage protector, the conductive wire 5 is fixedly coupled to the input terminal 1, so that when a user pull or twist the conductive wire 5, the conductive wire 5 may be twisted off or broken easily. In the present invention, the first conductive pin 15 and the second conductive pin 16 clamp the conductive wire 5 to achieve the effect of connecting the input terminal 1 with the conductive wire 5 as well as providing a specific moving space for the conductive wire 5 to effectively prevent the conductive wire 5 from being twisted off or broken.

While the present invention has been described by means of specific embodiments, numerous modifications and variations could be made thereto by those skilled in the art without departing from the scope and spirit of the present invention set forth in the claims.

What is claimed is:

1. An electric leakage protector, comprising an input terminal, an output terminal, a reset mechanism, a breaker mechanism and a current detecting mechanism for detecting the current condition of a circuit formed by the input terminal and the output terminal, and the input terminal having a fixed contact electrically coupled thereto, and the output terminal having a moving contact electrically coupled thereto, and an output terminal of the current detecting mechanism being coupled to a control terminal of the breaker mechanism, and the breaker mechanism being used for driving the moving contact and the fixed contact to be separated from each other, and the reset mechanism being used for driving the moving contact to be contacted with the fixed contact; the breaker mechanism comprising a separated elastic member for driving the moving contact to descend, and the reset mechanism comprising a reset column, a connecting member, a first reset elastic member, a moving seat and a second reset elastic member, and the separated elastic member being coupled to the connecting member through the moving seat, and the reset column having a latch groove for latching the connecting member, and the breaker mechanism being provided for driving the connecting member to retreat from the latch groove, and the second reset elastic member being provided for driving the reset column to ascend; and the first reset elastic member driving the connecting member to be latched into the latch groove after the reset column descends;

wherein the breaker mechanism comprises a hammer seat, an electromagnet electrically coupled to the current detecting mechanism, and an electric hammer slidably coupled to the hammer seat.

2. The electric leakage protector of claim 1, wherein [the breaker mechanism comprises a hammer seat, an electromagnet electrically coupled to the current detecting mechanism, and an electric hammer slidably coupled to the hammer seat, and] the electromagnet being provided for attracting the electric hammer, and the electric hammer having a bump formed at an outer periphery thereof, and the connecting member having a contact portion for abutting an end of the bump away from the connecting member, and the connecting member further comprising a giving way groove, and the electric hammer being moved in the giving-way groove.

3. The electric leakage protector of claim 1, further comprising a PCB, and an end of the separated elastic member and the fixed contact being fixed to the PCB, and the other end of the separated elastic member being fixed to the moving seat, and the moving contact being fixed to the other end of the separated elastic member.

4. The electric leakage protector of claim 3, wherein the reset column has a reset block disposed at an outer periphery thereof, and the second reset elastic member has an end coupled to the reset block and the other end coupled to the PCB.

5. The electric leakage protector of claim 1, wherein the moving seat has a sliding chute for passing the connecting member.

6. The electric leakage protector of claim 4, wherein the connecting member has an accommodating slot for accommodating the first reset elastic member, and the first reset elastic member has an end coupled to the moving seat and the other end coupled to a slot wall of the accommodating slot.

7. The electric leakage protector of claim 1, wherein the moving seat has a through slot for passing the reset column.

8. The electric leakage protector of claim 1, further comprising a base, and the base having a limit slot slidably coupled to the moving seat.

9. The electric leakage protector of claim 1, wherein the separated elastic member is made of an electrically conductive material, and the fixed contact is electrically coupled to the output terminal through the separated elastic member.

10. The electric leakage protector of claim 1, further comprising a conductive wire, and the input terminal including a first conductive pin and a second conductive pin for clamping the conductive wire.

* * * * *